United States Patent [19]

Gendron

[11] Patent Number: 4,462,538

[45] Date of Patent: Jul. 31, 1984

[54] DOOR HANGER ENVELOPE

[75] Inventor: Wilfred H. Gendron, Wilbraham, Mass.

[73] Assignee: Westvaco Corporation, New York, N.Y.

[21] Appl. No.: 495,620

[22] Filed: May 18, 1983

[51] Int. Cl.[3] ..... B65D 27/00

[52] U.S. Cl. ..... 229/68 R; 40/310; 206/806; 229/74

[58] Field of Search ..... 229/74, 73, 68 C, 68 R; 206/806; 383/9; 40/310, 331

[56] References Cited

U.S. PATENT DOCUMENTS

| | | | |
|---|---|---|---|
| 1,382,426 | 6/1921 | Kleebauer | 229/74 |
| 1,429,465 | 9/1922 | Tolg | 229/74 |
| 1,529,381 | 3/1925 | Townsend | 229/74 |
| 1,629,852 | 5/1927 | Wolf | 229/68 C |
| 1,969,428 | 8/1934 | Schwartz | 229/74 |
| 1,984,559 | 12/1934 | Wilcox | 229/74 |
| 2,100,768 | 11/1937 | Schuknecht | 229/68 C |
| 3,227,360 | 1/1966 | Krueger | 229/73 |
| 3,531,046 | 9/1970 | Carrigan | 229/73 |
| 4,197,984 | 4/1980 | Hartman et al. | 229/74 |

*Primary Examiner*—Stephen P. Garbe

[57] ABSTRACT

A two way envelope for initial hand delivery and subsequent return through the U.S. Postal Service is prepared from a single blank of envelope material or the like. The envelope is divided into two detachable portions along a perforated line. The first portion includes a means for hanging the envelope from a door knob or the like during initial delivery, and the second portion includes a sealable flap for first class delivery when returned. The means for hanging the envelope is adapted for use on either round door knobs or elongated, closed end door handles, and includes means for securing the envelope in place on the door knob or door handle.

6 Claims, 12 Drawing Figures

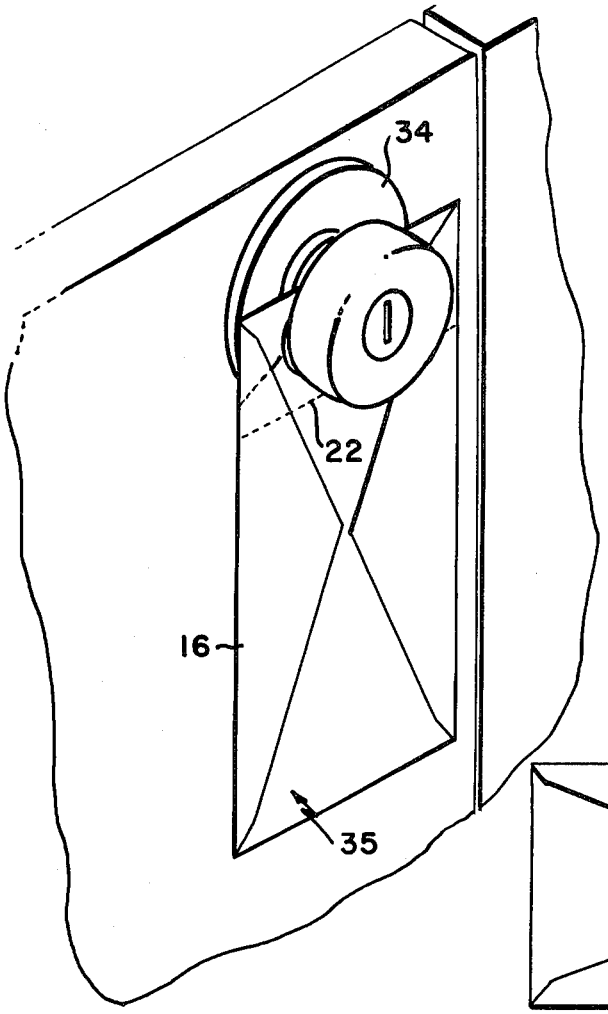
Fig 5
Fig 6.
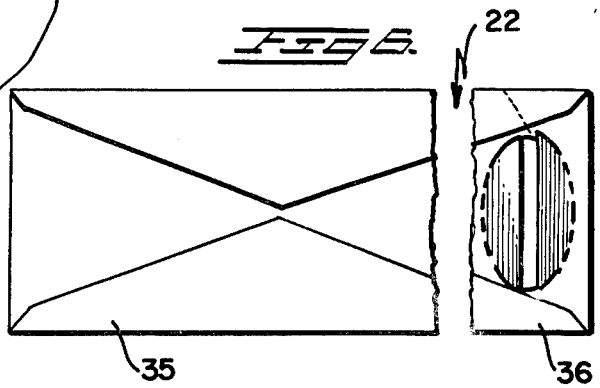
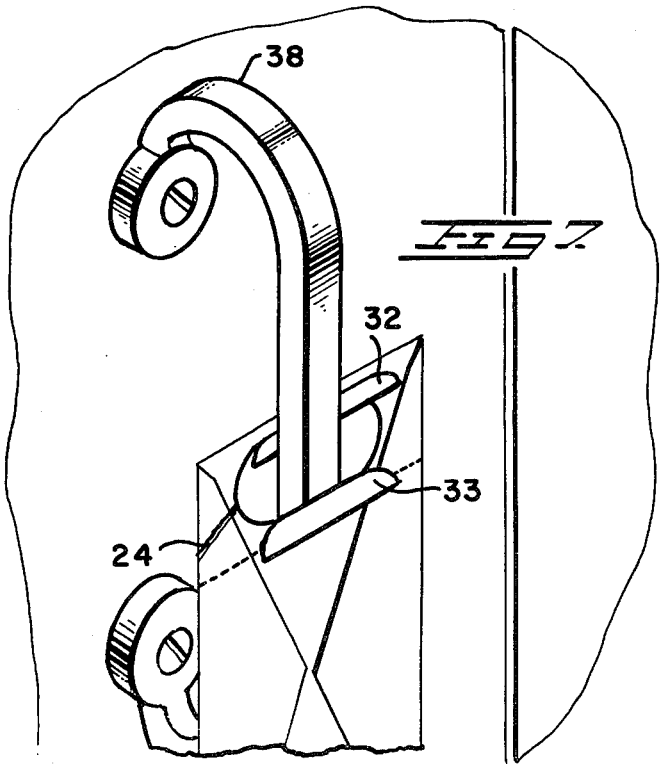
Fig 7

DOOR HANGER ENVELOPE

BACKGROUND OF INVENTION

The present invention relates generally to the field of envelope construction, and more particularly to an envelope that may be used for a dual purpose. Two way envelopes, i.e., those useful for both initial and return mailing through the U.S. Postal Service are well known. In such use, a bill, statement or the like is normally sent to a recipient and the envelope is constructed in such a way that the recipient can return payment using the same envelope. Obviously such an arrangement is more convenient and economical than the conventional practice of enclosing a return envelope by the sender.

However, where goods or services are not delivered through the mail, it is against postal regulations for the person delivering the goods or services to use the recipients mail box as a depository for a receipt, bill, statement or the like. Thus, when personal delivery of such materials cannot be made, there is no convenient means available for leaving the materials at the place of delivery to indicate both that a delivery was made and to provide a useful means for payment.

Accordingly, the envelope of the present invention differs from prior art two way envelopes in that it is only used once for delivery through the U.S. Postal Service. In particular, the envelope construction of the present invention is intended for personal delivery initially, and return through the U.S. Postal Service. For this purpose, the envelope is divided into two portions, a first portion which includes an integral means for hanging the envelope on a door knob or the like upon initial delivery, and a second portion which includes a sealing flap for return as first class matter through the U.S. Postal Service.

Several prior U.S. Patents show related products including U.S. Pat. No. 1,969,428 which illustrate a one piece returnable envelope with an opening for hanging it on a milk bottle; U.S. Pat. No. 1,984,559 which shows a related structure for hanging an envelope on a milk bottle; and U.S. Pat. No. 4,197,984 which teaches a composite envelope with a detachable portion that is fastened to a beverage bottle, and a second portion for conveying a message to a consumer. However, none of the prior art teaches a structure that includes the advantages or possesses the utility achieved with the construction specifically disclosed herein.

SUMMARY OF INVENTION

The present invention is directed to improvements in a two way envelope that is normally delivered initially in person and which is returned in normal fashion through the U.S. Postal Service. Moreover, the envelope of the present invention is the first of its kind to be constructed so as to comprise two detachable portions, namely, a first portion which includes a means for hanging the envelope over a door knob or the like when initially delivered, and a second portion which includes a sealable closure flap for first class return through the U.S. Postal Service. A top opening envelope structure is specified as being preferred for its ease of insertion. In addition, the envelope of the present invention also includes means for securing the envelope on the door knob or the like when initially delivered and for accommodating either round, protruding door knobs, or elongated, closed end door handles. Accordingly, the envelope structure of the present invention is particularly useful for those who make personal deliveries of goods or services as a means for conveniently leaving a bill, statement or receipt for such goods or services at the place of delivery.

The envelopes of the present invention are prepared from single blanks of envelope material on automatic envelope making machinery. The envelopes may be provided with windows if desired, or they may be constructed with uncut front and rear panels. Moreover, the envelopes of the present invention may take any desired form including diagonal seam style envelopes with V-shaped top and bottom closure flaps or side seam style envelopes with straight closure flaps. The improvements incorporated into the envelopes of the present invention include a locking feature for securing the envelopes on the door knobs or the like when initially delivered and the versatility of being usable on door handles of various styles.

The envelopes of the present invention include a return portion and a portion adapted for hanging the envelope on a door knob or handle at the place of delivery, which portions may be separated from one another along a preforated line in use. The envelopes are formed from single banks of envelope stock and include in general a front panel, rear panel, top closure flap and one or more side closure flaps. The diagonal seam style envelopes are of conventional design with top and bottom closure flaps and side closure flaps which form the rear panel. In any event, the portion of the envelope used for suspending it from a door knob or the like is formed from a part of the front panel and an adjacent side closure flap in the diagonal seam style envelopes, and from a pair of extention panels attached to the front and rear panels of the side seam style envelopes.

The door hanger portion of each style envelope is provided by an opening of generally elliptical shape produced with partial cut outs in one end of the envelope blank material. The partial cut outs are designed to leave a pair of flap elements in the door hanger opening which elements serve to grip the door knob after it is applied thereto and so as to secure the envelope on the door knob. In the case of enlarged door knobs or door handles having completely closed ends, the door hanger portions are provided with additional perforated tear lines which extend from an outside edge of the envelope to the door handle opening. Thus, when the door hanger openings are too small to fit over a large door knob, or the envelope must be hung from a door handle having closed ends, the envelope may be torn along the aforementioned tear lines to gain access to the door hanger opening. Subsequently, as shown in one of the embodiments herein, the torn part of the door hanger portion may then be resealed to a closed condition with appropriately placed pads of pressure sensitive adhesive or the like.

It is an object of the present invention to provide a two way envelope including a first class return portion and a detachable door hanger portion for personal delivery.

Another object of the present invention is to provide a two way envelope with a door hanger portion that includes self locking means for securing the envelope in place on a door knob or the like.

A further object of the present invention is to provide a means in a door hanger envelope for adapting the door hanger portion to large door knobs or other style door handles with completely closed ends.

Other objects, features and advantages of the present invention will become apparent from a review of the following specification, when taken in conjunction with the accompanying drawing.

DESCRIPTION OF DRAWING

FIG. 5 is a partial perspective view showing the door hanger envelope applied to a conventional door knob;

FIG. 6 is a plan view showing the door hanger portion detached from the first class return portion of the door hanger envelope prepared from the blank of FIG. 1;

FIG. 7 is a partial plan view showing the door hanger envelope applied to a door handle having closed ends;

DETAILED DESCRIPTION

Figure 1:
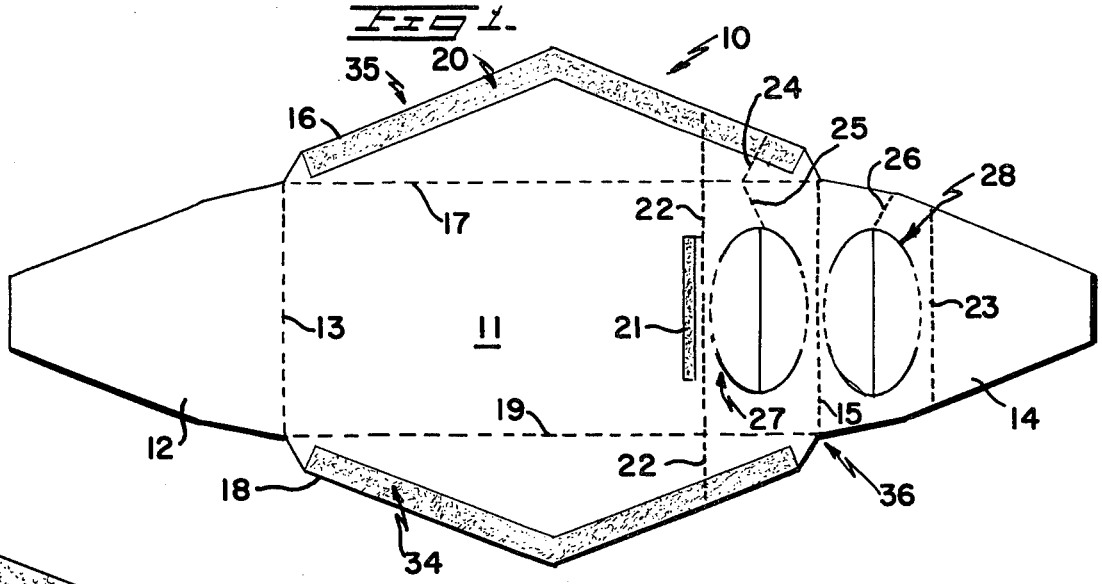
FIG. 1 is a plan view of a blank structure for forming an envelope according to one embodiment of the present invention.

Referring now in more detail to the drawings in which like numerals represent like components in the several views, FIG. 1 shows a blank structure 10 for preparing an envelope according to a first embodiment of the present invention. The blank 10 comprises a front panel 11 which may be provided with a window if desired (not shown), a pair of side closure flaps 12 and 14 foldably attached to the front panel along scored lines 13 and 15, and a pair of top and bottom closure flaps 16 and 18 foldably attached to the front panel along scored lines 17 and 19. The blank 10 is divided into a return envelope portion 35 and a door hanger portion 36 by a perforated line 22. Meanwhile a strip of adhesive 21 is applied to the front panel 11 adjacent to the perforated line 22 to close one end of the return envelope and adhesive is applied at 20 and 34 for sealing the top closure flap 16 and bottom closure flap 18 respectively.

Figure 2:
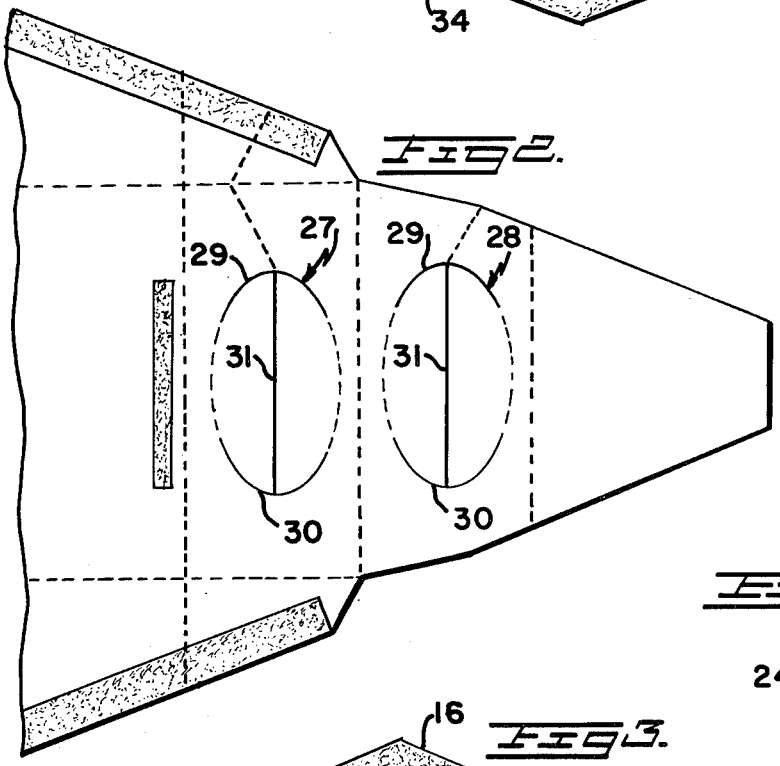
FIG. 2 is a partial plan view of the blank of FIG. 1 showing the construction of the door hanger portion of the envelope.
Figure 4:
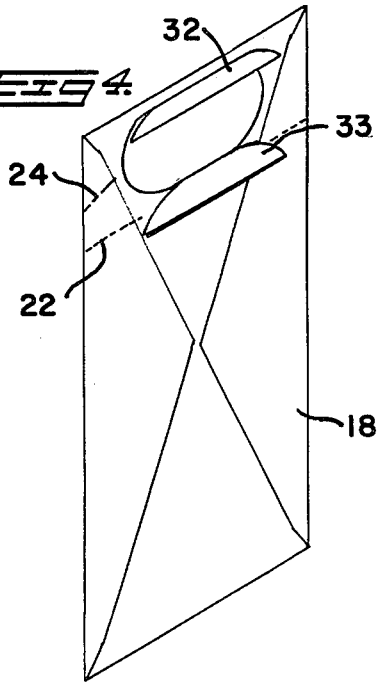
FIG. 4 is a perspective view of the door hanger envelope prepared from the blank of FIG. 1.
Figure 3:
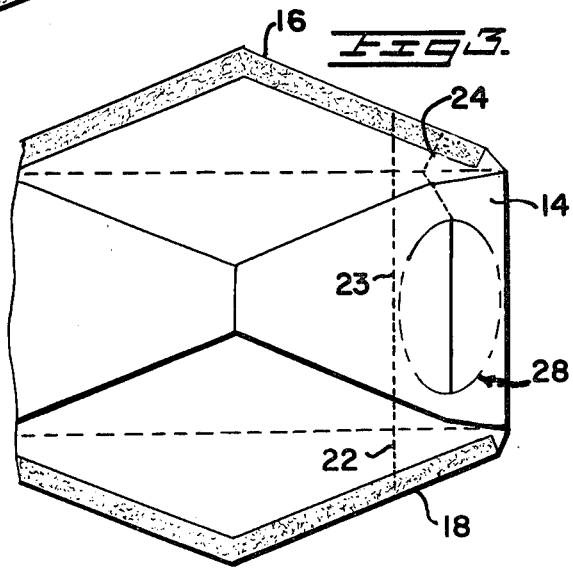
FIG. 3 is a partial plan view showing a first folding step for the blank structure shown in FIG. 1.
Figure 8:
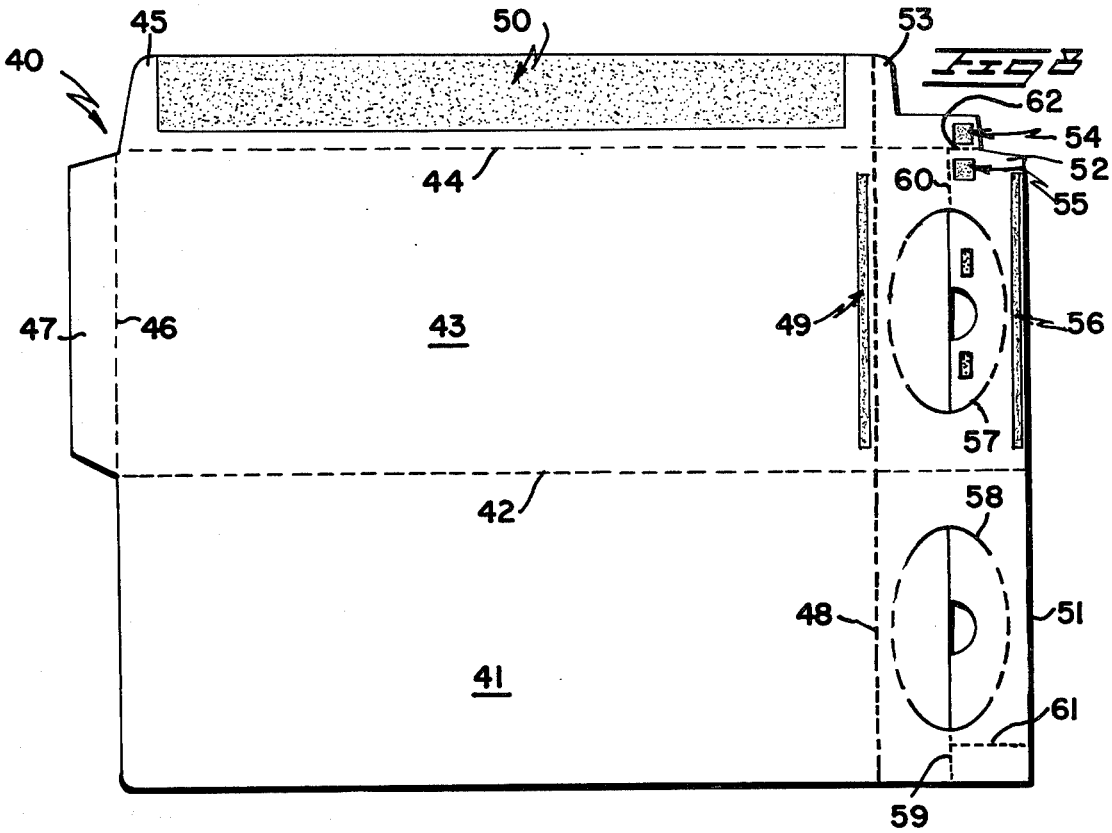
FIG. 8 is a plan view of a blank structure for forming an envelope according to a second embodiment of the present invention.

The portion of the blank 10 to the right of perforated line 22 is cut and scored to provide the means for hanging envelope from a door knob or the like. For this purpose a pair of openings 27 and 28 are formed in the right side of front panel 11 and in the closure flap 14 that are of the same size and shape and located equidistant from score line 15. As shown in FIG. 2, the openings are generally elliptical in shape and are formed by partial curved cut lines 29 and 30 at the ends of the major axis of the ellipse and a straight cut line 31 whch bisects the minor axis of the ellipse and intersects the curved cut lines 29,30. The ends of the cut lines 29,30 are joined by perforated or scored fold lines to provide flap elements 32,33 within the openings 27,28. Outside access to the openings 27,28 is provided in the blank structure 10 by perforated lines 24,25 and 26 which become superimposed with one another when the envelope is formed. FIGS. 3 and 4 illustrate the envelope in a first folded stage and a final stage to demonstrate the above noted orientation.

In FIG. 3, the side closure flap 14 is folded over panel 11 about score line 15 to superimpose opening 28 over opening 27. At the same time, perforated line 26 is superimposed over perforated line 25 and flap 14 is adhered to front panel 11 at adhesive strip 21 to form one end of the return envelope 35. The formation of the envelope is completed by folding bottom flap 18 upwardly about fold line 19 to adhere it to the side closure flaps 12,14 with the adhesive strip 34. This step forms the bottom of the return envelope 35. Later, with the top closure flap 16 temporarily folded downward the perforated line 24 becomes superimposed over the perforated lines 25 and 26. In this condition, particularly as shown in FIG. 4, the envelope is ready for initial personal delivery where it is hung on a door knob or the like. For this purpose, the flap elements 32,33 are bent outwardly to permit access to the door hanger opening.

FIG. 5 shows the envelope of FIG. 4 hung on a normal sized door knob 36 where the door hanger openings 27,28 are large enough to fit over the door knob. In this condition, the flap elements 32,33 are folded outwardly and are wedged against the inner surfaces of the door knob to secure the envelope in place. Thus by leaving the flap elements 32,33 foldably attached to the envelope structure, two advantages are achieved. First the envelope is not required to go through an added production step where the otherwise waste flap material would have to be stripped and discarded, and secondly the flap elements 32,33 are put to a good use for securing the envelope in place. When placed on the door knob, the envelope is relatively difficult to remove without tearing along the perforated line 22. FIG. 6 shows the envelope structure separated along the perforated line 22 into its two portions, namely, the return envelope portion 35 and the door hanger portion 36 which is subsequently discarded.

In the situation where the door knob is extra large or the door is provided with a door handle with closed ends, the envelope structure may be hung on the door knob or handle as follows. FIG. 7 illustrates a door handle 38 with closed ends. For this situation, the envelope is simply torn along the aligned perforated lines 24,25,26 to provide outside access to the door hanger openings 27,28. The envelope can then be slipped over the handle 38 where the flap elements 32,33 tend to secure the envelope in place. When it is desired to use the return portion of the envelope, it is simply torn apart along perforated line 22.

A second embodiment of the present invention applied to a straight side seam envelope is shown in FIGS. 8–12. The blank structure 40 for making such an envelope has a return portion comprising a front panel 43 and a rear panel 41 foldably connected along a score line 42. A top closure flap 45 is foldably attached to the front panel 43 along a score line 44 and an end closure flap 47 is foldably attached to front panel 43 along a score line 46. The top closure flap 45 is provided with an adhesive strip 50 for sealing the return envelope portion.

The envelope hanging portion is provided for in blank 40 in the form of a pair of extension panels 52 and 51 which are foldably attached to one another by a continuation of score line 42 and which are attached to the front and rear panels 43,41 respectively by a perforated line 48. The extension panels 51,52 are each provided with openings 57,58 for use in hanging the envelope from a door knob or the like. As in the case of the first embodiment described hereinbefore, the openings 57,58 are generally elliptical in shape and are formed by partial curved cut lines at the ends of the major axis of the ellipse and straight cut lines that bisect each ellipse about its minor axis. The straight cut lines intersect the curved cut lines and the ends of the curved cut lines are joined together along curved fold lines to form the locking flap elements 62,63 within the openings 57,58. The blank structure 40 further includes a tab portion 53 that is foldably attached to the top closure flap 45 along an extension of score line 48 and to one of the extension panels 52 along score line 44 extended. Adhesive patches are applied at 49 to front panel 43 for closing one end of the return envelope portion, and at 56 for adhering the two extension panels 51,52 together for forming the door hanger portion of the envelope. In addition, the extension panels 51,52 include a series of strategically located perforated lines 59,60,61 and 62 for permitting access to the openings 57,58 from outside a formed envelope, and a pair of patches of pressure sensitive adhesive 54,55 on tab portion 53 and extension panel 52 for temporarily closing the door hanger portion of the envelope in use.

Figure 9:
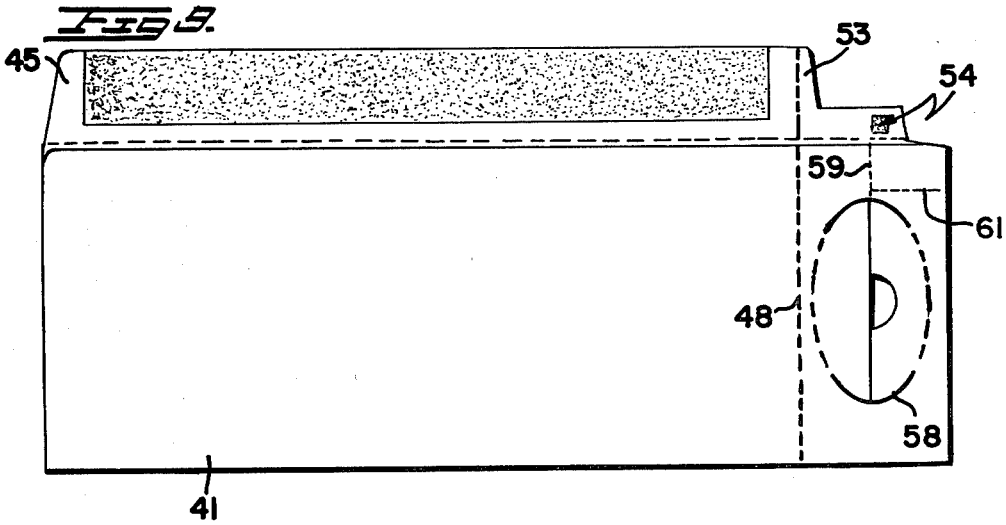
FIG. 9 is a plan view of the envelope formed from the blank of FIG. 8.
Figure 10:
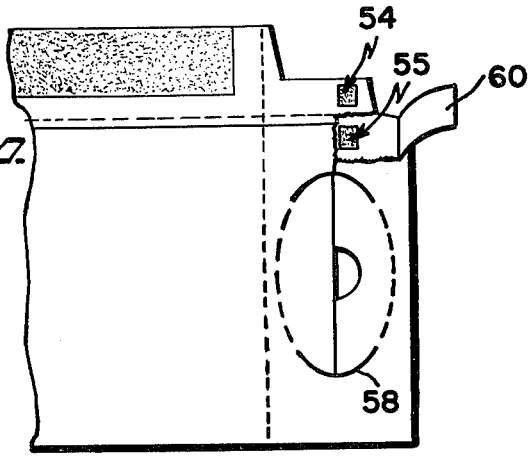
FIG. 10 is a partial plan view illustrating the details of a means for temporarily securing the envelope in position on a door handle.

FIG. 9 shows the envelope folded and glued prior to use. When the rear panel 41 and extension panel 51 are folded upwardly and adhered to panels 43 and 52, the openings 57,58 become superimposed with one another and perforated lines 59,60 are similarly superimposed. In this condition, the access panel in extension panel 51 covers the adhesive patch 55 on panel 52. Access to the adhesive patch 55 is provided by tearing the panel along perforated lines 59 and 61 and folding the access panel away as shown in FIG. 10.

Figure 11:
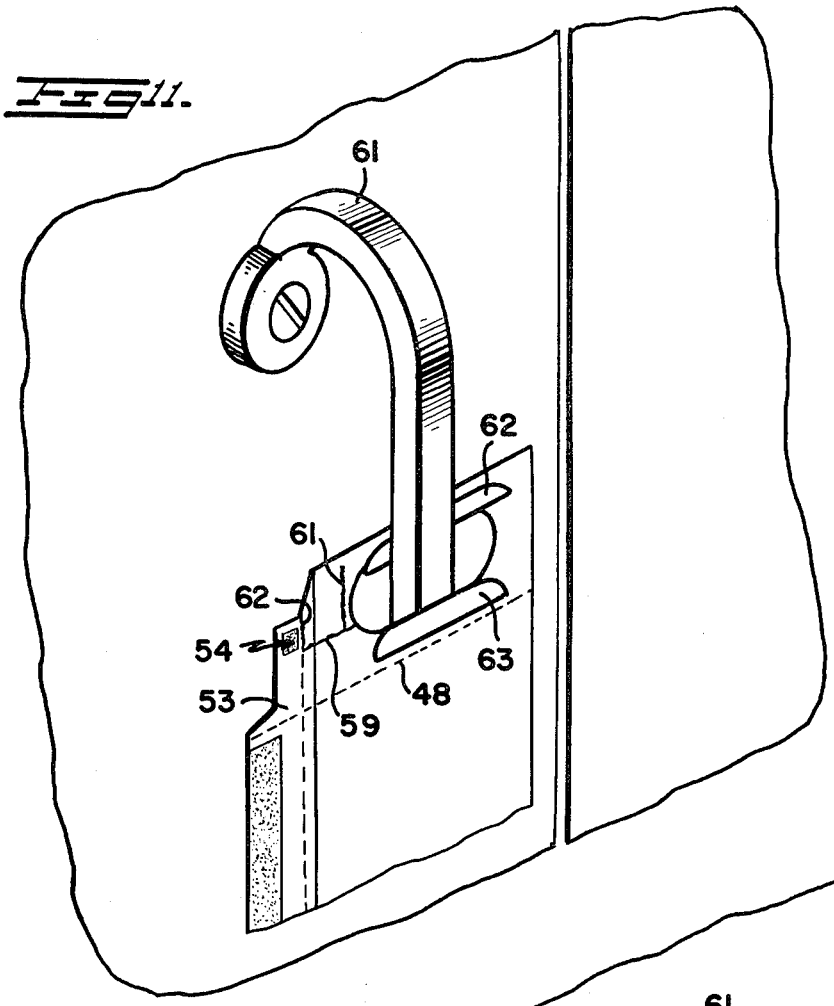
FIG. 11 is a partial perspective view showing the envelope of FIG. 9 applied to a door handle having closed ends.
Figure 12:
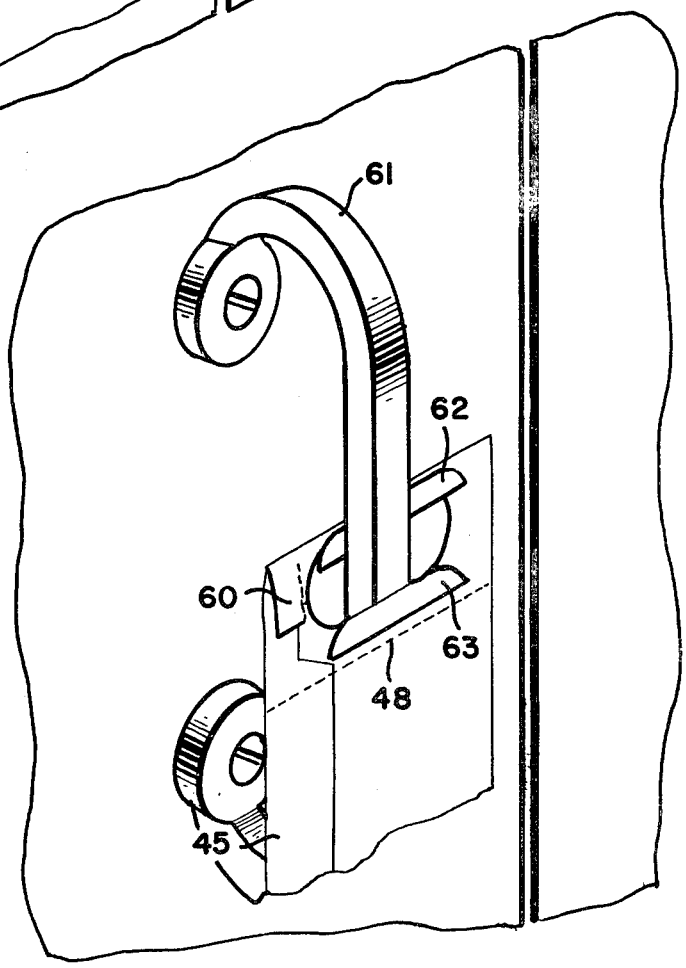
FIG. 12 is a partial perspective view of the envelope as shown in FIG. 11 with the temporary securing means in place.

When the envelope structure shown in FIG. 9 is used on normally sized door knobs the locking flap elements 62,63 are bent outwardly when the envelope is slipped over the door knob substantially as shown in FIG. 5. However, when an unusually large door knob is encountered, or the envelope structure must be hung on a door handle of the closed end type as shown in FIGS. 11 and 12, the envelope must be torn along the perforated lines 59 and 62 to provide outside access to the opening 58. After the envelope is slipped into place, the door hanger portion of the envelope can be temporarily closed by lifting the access panel in extension panel 51 to expose the adhesive patch 55. At that time, the closure flap 45 and extension tab 53 may be folded over to place the pressure sensitive adhesive patches 54 and 55 in contact. This step further serves to temporarily close the flap 45 to keep anything placed in the envelope from inadvertently falling out. Thus when the envelope of the present invention is initially delivered and left hanging on a door knob or the like, integral flap elements incorporated into the door hanger openings provide a ready means for securing the envelope to the door knob or the like. Where the door knobs are larger than the door hanger openings or when a door handle with closed ends is encountered, the envelope of the present invention provides a readily available access means for hanging the envelope in place. Finally, where desired, the envelope may include a pair of cooperating pressure sensitive adhesive patches for temporarily closing the closure flap and temporarily closing separated portions of the door hanger part of the envelope.

It will be seen that the present invention provides a simple yet expedient means for suspending a two way envelope on a door knob or the like upon initial personal delivery, which envelope may be separated into a door hanger portion and a return envelope portion for return use through the U.S. Postal Service. While only two embodiments have been fully disclosed, it will be understood that the present invention may be capable of taking other forms particularly as set forth within the scope of the appended claims.

I claim:

1. A two way envelope for initial hand delivery and subsequent return as first class matter through the U.S. Postal Service comprising, an envelope structure divisible into two portions along a perforated line, said first portion including means formed therein for hanging the envelope from a door knob or the like upon initial delivery and said second portion including an integral closure flap and sealed ends, said means for hanging the envelope on a door knob or the like further comprising an opening in the door hanger portion formed in the general shape of an ellipse by partial curved cut lines located at the ends of the major axis of the ellipse and a straight cut line which bisects the minor axis of the ellipse and intersects the curved cut lines, said curved cut lines being joined together at their ends by fold lines to provide a pair of flap elements within the door hanger opening which are used to secure the envelope in place on a door knob or the like, said door hanger portion further including a means for providing access to the door hanger opening from an outside edge of the envelope structure.

2. The envelope of claim 1 wherein the means for providing access to the door hanger opening from an outside edge thereof comprises a series of perforated and superimposed tear lines in various panels of said envelope which extend from an outer edge of the envelope to the door hanger opening within said door hanger portion.

3. The envelope of claim 2 wherein a means is provided in said envelope structure for temporarily closing the closure flap of the return portion of said envelope and for simultaneously temporarily closing the door hanger portion of said envelope.

4. The envelope of claim 3 wherein the temporary closing means for said door hanger portion and closure flap comprises cooperating patches of pressure sensitive adhesive one of which is normally covered by an access panel.

5. The envelope of claim 3 which comprises a diagonal seam style envelope.

6. The envelope of claim 4 which comprises a side seam style envelope.

* * * * *